US005590576A

United States Patent [19]

Ingwersen et al.

[11] Patent Number: 5,590,576

[45] Date of Patent: Jan. 7, 1997

[54] FEED ASSEMBLY FOR CONNECTOR TERMINATION APPARATUS

[75] Inventors: Peter Ingwersen, Gilberts; Lawrence M. Kurek, Elgin; Douglas L. Heisner, Downers Grove, all of Ill.

[73] Assignee: Molex Incorporated, Lisle, Ill.

[21] Appl. No.: 324,813

[22] Filed: Oct. 17, 1994

[51] Int. Cl.[6] ..... B26D 7/06

[52] U.S. Cl. ..... 83/147; 83/158; 83/160; 83/365; 83/370; 29/417; 29/759

[58] Field of Search ..... 83/111, 158, 160, 83/441.1, 367, 365, 370, 371, 613, 102, 147, 162; 29/417, 720, 709, 712, 714, 564.6, 759

[56] References Cited

U.S. PATENT DOCUMENTS

| | | | |
|---|---|---|---|
| 2,506,550 | 5/1950 | Morrison | 29/714 |
| 3,264,918 | 8/1966 | Lockart | 83/160 |
| 3,350,757 | 11/1967 | Bowles | 83/863 |
| 4,087,308 | 5/1978 | Baugher et al. | 29/720 |
| 4,099,322 | 7/1978 | Tait | 29/417 |
| 4,310,967 | 1/1982 | Funcik et al. | 29/749 |
| 4,646,404 | 3/1987 | Matsui | 29/564.6 |
| 4,830,554 | 5/1989 | Lopez | 29/417 |
| 4,945,797 | 8/1990 | Hahn | 83/367 |
| 5,005,278 | 4/1991 | Sado et al. | 29/709 |
| 5,272,800 | 12/1993 | Rooney et al. | 29/759 |
| 5,276,954 | 1/1994 | Gerrans et al. | 29/564.6 |

FOREIGN PATENT DOCUMENTS

| | | | |
|---|---|---|---|
| 406091445 | 4/1994 | Japan | 29/712 |

*Primary Examiner*—Eugenia Jones
*Assistant Examiner*—Charles Goodman
*Attorney, Agent, or Firm*—Charles S. Cohen

[57] ABSTRACT

An apparatus for loading individual connectors into a wire-harness making machine includes a feed track which feeds a supply of connectors which have been separated from a connector supply chain. The lead connector is advanced into a feed channel whereupon a severing knife is advanced into the feed channel to separate the lead connector from an adjacent connector. The severing knife remains in place momentarily as a shuttle mechanism is actuated to move the severed lead connector along the feed channel, the severing knife blade forming a portion of the feed channel during the shuttling of the severed connector. Optical sensors may be mounted in proximity to the severing knife in order to verify the presence or absence of a connector prior to severing.

17 Claims, 5 Drawing Sheets

FEED ASSEMBLY FOR CONNECTOR TERMINATION APPARATUS

BACKGROUND OF THE INVENTION

The present invention relates generally to the assembly of wire harnesses. More particularly, the present invention relates to a new and improved feed assembly for use in the assembly of wire harnesses which reliably feeds, or loads, individual connector elements from feed supplies to a station for further processing, such as terminating a plurality of electrical wires to the connector elements.

Wire harnesses are used in a variety of electronic products, such as televisions and computers, as well as automobiles. These wire harnesses may take a variety of forms. In one such form, the wire harnesses may comprise a series of parallel wires having their opposing ends terminated to corresponding, and opposing, first and second electrical connector elements. The connector elements terminated to the opposing ends of the harness wires may be formed from either a single connector housing component or from multiple connector housing components interlocked together to define a single connector housing. In this latter type of construction, the connector housing may comprise an insulative or dielectric lower base component having wire-receiving openings therein and a cavity which receives an upper insulative component having a series of electrical terminals mounted therein. During termination, the conductor portions of wires are inserted into wire-receiving openings in the housing and then the upper component is pressed into engagement with the base component to displace the insulation surrounding the conductors of the wires and effect termination thereof.

In the assembly of these types of wire harnesses, the upper and base connector components are partially engaged with each other and are fed in serial order to a termination assembly where wires are fed into their wire-receiving openings and the connector components are interlocked together so that the electrical terminals thereof firmly engage the conductive portions of the wires therein. An example of this type of connector is shown in German Patent No. DE 41 28 329.

Quite often, individual connector elements are fed to a wire termination machine, such as that described in U.S. Pat. No. 4,136,440, wherein the connector components are manually loaded into a first termination station. Manual loading of connector components, although desirable from the standpoint that it permits an inspection of the connector component to be carried out prior to feeding, greatly reduces the maximum speed at which the production output of wire harnesses may be maintained.

In other wire harness assembly machines, such is that described in U.S. Pat. No. 4,310,967, issued Apr. 19, 1982 and assigned to the assignee of the present invention, the connector elements are mechanically fed from a magazine into a termination station wherein wires are applied thereto. The connector housings are fed individually in serial order into an indexing assembly which holds them in position for termination. Although more effective than a manually loaded termination apparatus, such an apparatus does not contemplate the feeding of a plurality of connector housings or elements from interconnected supplies of same into an indexing mechanism.

Accordingly, in order to overcome the shortcomings of the prior art, it is an object of the present invention to provide a new and improved feed assembly for serially feeding rows of connectors to a work station.

It is another object of the present invention to provide a feed assembly suitable for use in conjunction with a wire harness assembly apparatus in which the feed assembly is adapted to index, feed and separate multiple connector elements from multiple supplies of interconnected connector elements.

It is a further object of the present invention to provide a connector feeding apparatus which separates successive rows of connector elements which are advanced in side-by-side order from multiple supplies of connector elements and advances the separated rows along a feed path into registration with a connector element termination apparatus.

It is still another object of the present invention to provide a connector loading apparatus for a wire harness-making machine which separates a leading row of connectors from advancing rows of multiple interconnected supplies of connectors, the apparatus severing the leading row of connectors from the advancing supplies by passing a severing knife through interconnecting portions of the connectors, maintaining the severing knife in place and advancing the severed rows of connectors sequentially alongside the severing knife to a processing station.

SUMMARY OF THE INVENTION

In accordance with these and other objects, the present invention provides a new and improved feed assembly for mounting on a wire harness-making machine and which is adapted for operation in conjunction with a wire termination device located within the harness-making machine. More particularly, the feed assembly comprises connector element feed or guide means, connector element severing means and connector element transfer means. The feed assembly additionally includes an alignment and verification means which cooperates with the severing means and connector element advancement means.

In accordance with the preferred embodiment of the invention, a connector element feed means is provided which receives upon a feed belt portion thereof, a plurality of connector elements interconnected together such as in the form of an endless belt of connector elements, the connector feed means terminating at a connector element feed slot, which receives a single row of connector elements advanced from the connector element supply into a work position within the apparatus. The single row of connector elements is scanned by an alignment and position verification means which verifies the presence or absence of all the connectors in the row and signals an alarm if one or more connector elements are missing in the row.

In accordance with the preferred embodiment, a severing means is provided in conjunction with the alignment means and separates the lead row of connector elements from the advancing supply of connector elements by passing a severing blade through bridging portions which interconnect adjoining rows of connector elements. The severing blade remains in place after a severing stroke and defines a guide surface along which the row of separated connector elements are advanced into position through a feed channel en route to further processing. The preferred embodiment also includes a means for advancing the separated row of connector elements along the feed channel to the further processing station. In accordance with this invention and utilizing this feed assembly method, reliable separation and loading of connector elements in successive rows from multiple feed supplies is attained which enhances the ability of a wire processing machine used in conjunction with the preferred embodiment to more efficiently process the connector elements.

These and other objects, features and advantages of the present invention will be clearly understood through a consideration of the following detailed description.

BRIEF DESCRIPTION OF THE DRAWINGS

In the course of this description, reference will be frequently made to the attached drawings in which.

DETAILED DESCRIPTION OF THE PREFERRED EMBODIMENTS

Figure 1:
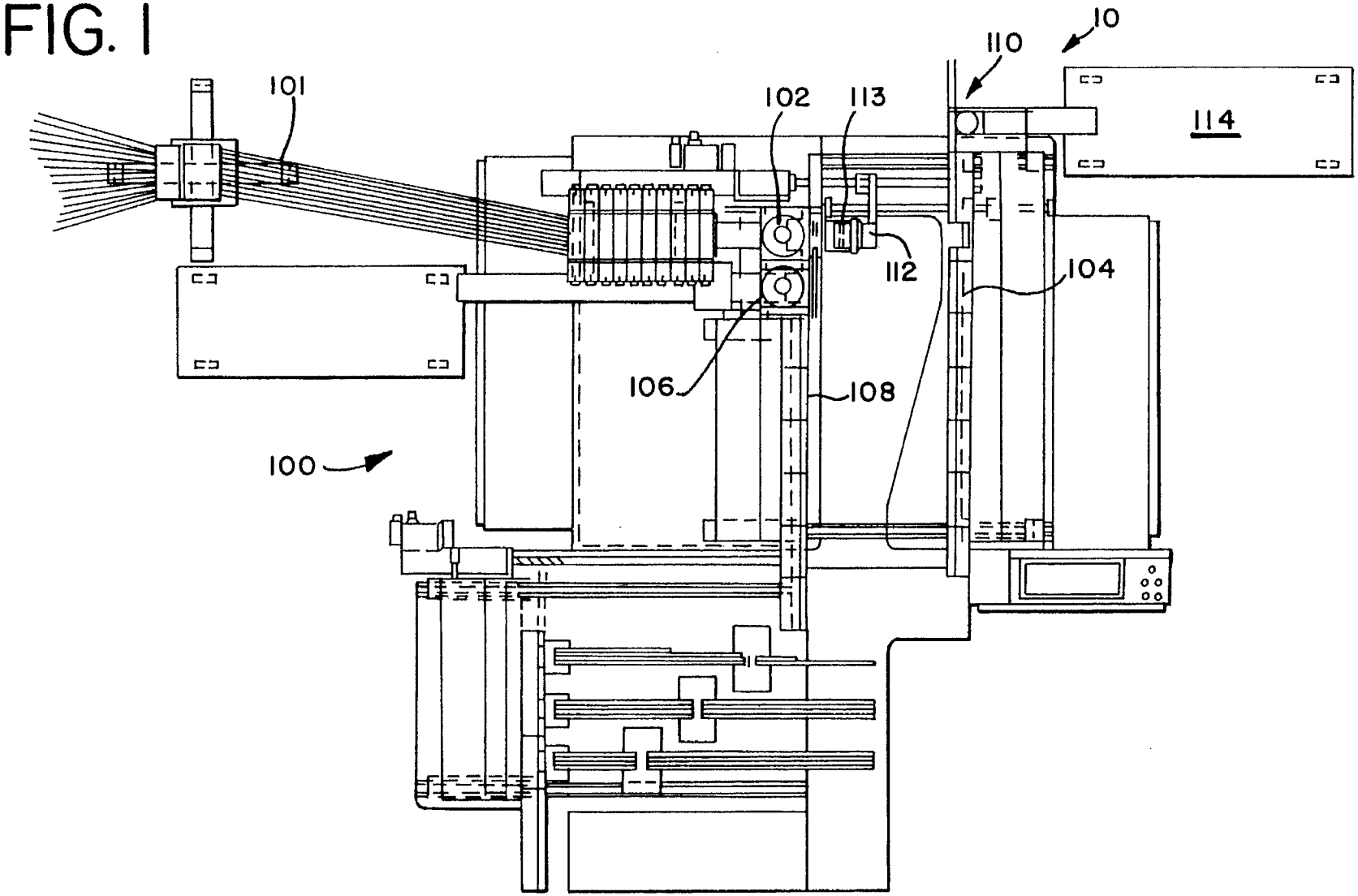
FIG. 1 is a plan view of a harness-making machine in which the present invention may be utilized.
Figure 2:
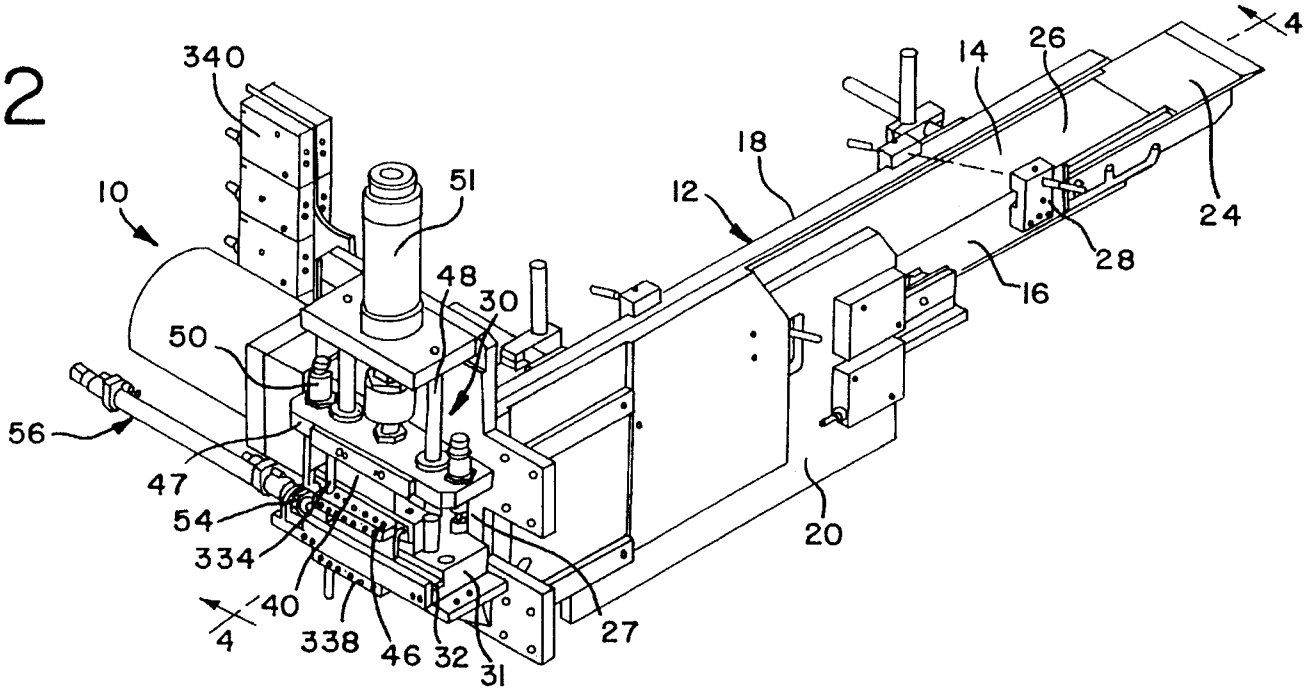
FIG. 2 is a perspective view of one embodiment of a feed assembly apparatus constructed in accordance with the principles of the present invention intended for use in the wire harness-making machine of FIG. 1.
Figure 3:
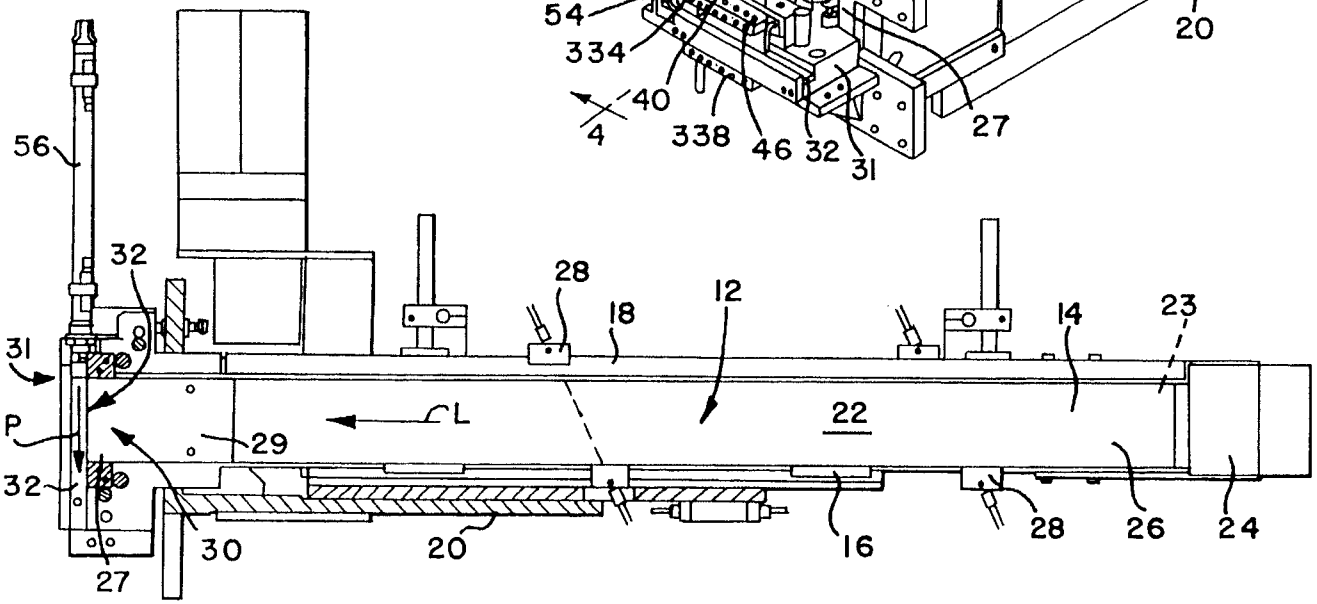
FIG. 3 is a plan view of the feed assembly of FIG. 2.
Figure 5:
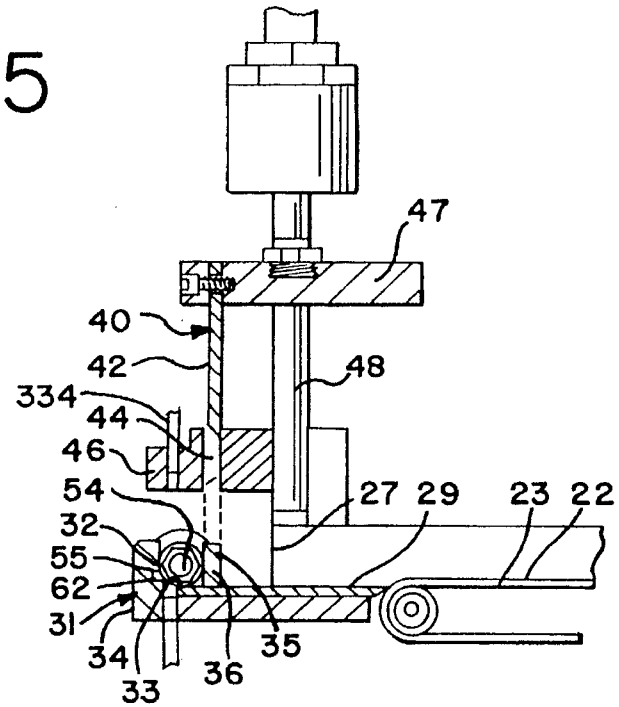
FIG. 5 is an enlarged sectional view of the loading station of the feed assembly apparatus of FIG. 4.

Referring now to the drawings, a wire harness connector housing feed apparatus 10 incorporating the principles of the present invention is shown. The feed apparatus 10 is preferable integrated into an overall wire harness-making machine 100, illustrated in FIG. 1, which is suitable for use in the automated production of wire harnesses. The wire harnesses made on the machine 100 are generally of the type having a plurality of spaced apart wires extending between two opposing connectors.

The wire harness-making machine 100 is one in which a first set of connector elements is first terminated to a series of wires 101 at a first termination station 102. The terminated first connector elements are then moved to a first lateral transfer track 104. If desired, a set of second connector elements may be then terminated to the opposing ends of the wires 101. If a second set of connector elements have been terminated, they are moved with a completed wire harness along a second transfer track 108 which extends parallel to the first track 104 for subsequent processing such as wire harness testing. The present invention is utilized in such a harness-making machine 100 as a loading assembly 110 which loads a connector element or a group of connector elements into a termination transfer carriage assembly 112 which transfers the connector elements across from the first transfer track 104 to the termination station 102.

Figure 7:
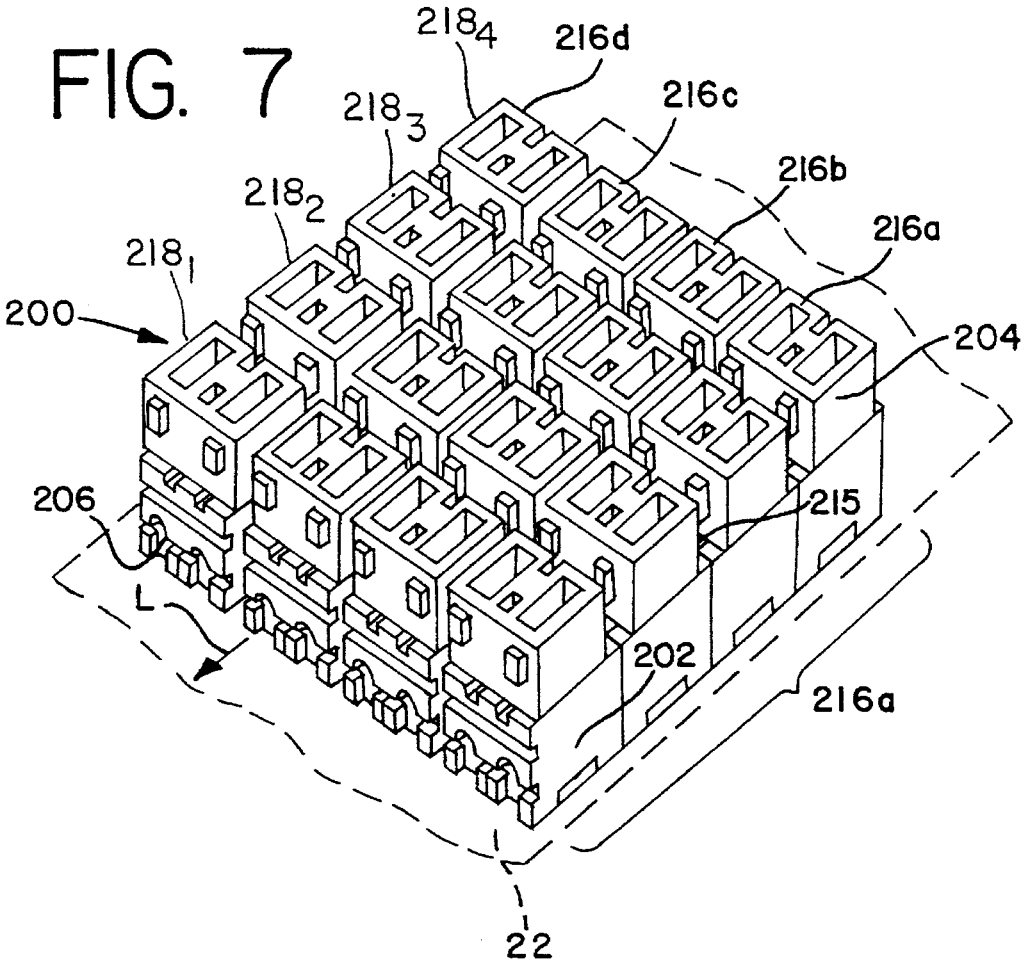
FIG. 7 is a perspective view of a feed supply of interconnected chains of connector elements in the form of a continuous supply chain suitable for use in the feeding apparatus of FIG. 2 and generally shown positioned on a conveyor.
Figure 8:
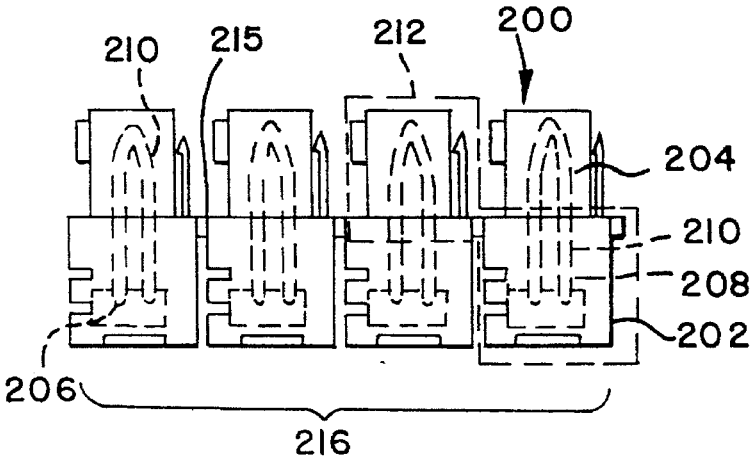
FIG. 8 is a side elevational view of the feed supply of connector elements of FIG. 7.

The connector elements loaded by the present invention may be of the two-component style construction, in which two interengaging housing components 202, 204 (FIGS. 7 & 8) cooperate and interlock together to define a connector housing 200. These components may include a base component 202 and a head component 204. The base component 202 has a plurality of wire-receiving openings 206 therein which lead to internal cavities 208, which in turn receive the free ends of a corresponding number of harness wires therein for termination. The head component 204 rests upon the base component 202 and partially extends into the internal cavities 208 thereof. The head component 204 contains a plurality of electrical terminals 210 disposed in the cavities 208 thereof which are aligned with the wire-receiving openings 206 of the base component 202. When the two connector housing components 202, 204 are pressed together by the termination station 102 of the harness-making machine 100, the terminals 210 are forced into electrical engagement with the conductor portions of the wires situated within the wire-receiving openings 206. It will be understood that the connector housings 200 illustrated in FIGS. 7 & 8 are merely illustrative of one style of housing structure which may be utilized with the present invention. Other connector housing designs may be similarly used in the present invention.

The two connector housing components 202, 204 are formed by injection molding in modules 200 encircled at 212 consisting of a head component of one connector and a base component of an adjacent connector interconnected by integral bridging portions 215. These individual modules of connector components 200 are then assembled to form a continuous chain, or bandolier 216, of interconnected connectors 200.

It should be noted that although the electrical connector elements depicted herein are shown as many relatively short members, the principles of the present invention could be used with smaller or larger connector elements that are processed and terminated simultaneously. In other words, rather than four connector elements having two termination positions each, two connector elements having four termination positions (or one connector element having eight termination positions, etc.) could be utilized.

For the connector size depicted in the drawings, in use, the connector supply chains 216 are arranged in side-by-side columns **216*a*, 216*b*, 216*c* and 216*d* wherein each connector housing 200 is aligned with connector housings located in adjacent columns of connector supply chains. In FIG. 7, four chains or columns 216*a*, 216*b*, 216*c* and 216*d* parallel to axis L are shown as an example. Consequently, the connector supply chains 216, taken as a whole, thereby define a series of successive rows $\mathbf{218}_1$, $\mathbf{218}_2$, $\mathbf{218}_3$, $\mathbf{218}_4$ . . . $\mathbf{218}_n$ of connectors extending perpendicularly to the axes L of the multiple supply chains 216. Only rows $\mathbf{218}_1$ through $\mathbf{218}_4$ are shown in FIG. 7. Hereafter, each row of connectors 200 will be generally referenced by numeral 218. The feed assembly 10 of the present invention separates successive lead rows 218 of these connectors from the multiple supply chains 216 and feeds (or loads) the separated successive rows 218 into a transfer carriage 112 for processing by another processing station, such as one in which the connector housings are terminated to a plurality of electrical wires. With the multiple supply chains 216 interconnected along their axes L in columns, it is desirable to separate connectors 200 successively as rows 218 from the multiple supply chains 216**.

Figure 4:
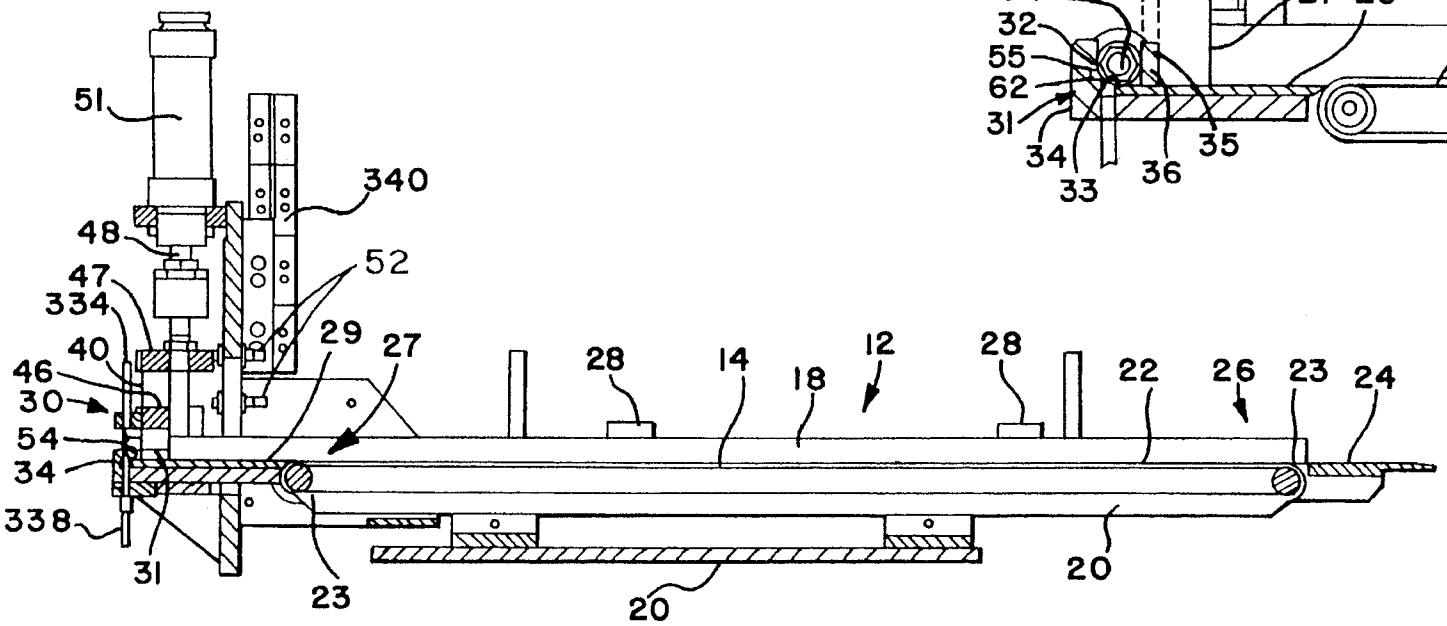
FIG. 4 is a sectional view of the feed assembly apparatus of FIG. 2, taken generally along line 4—4 thereof.
Figure 6:
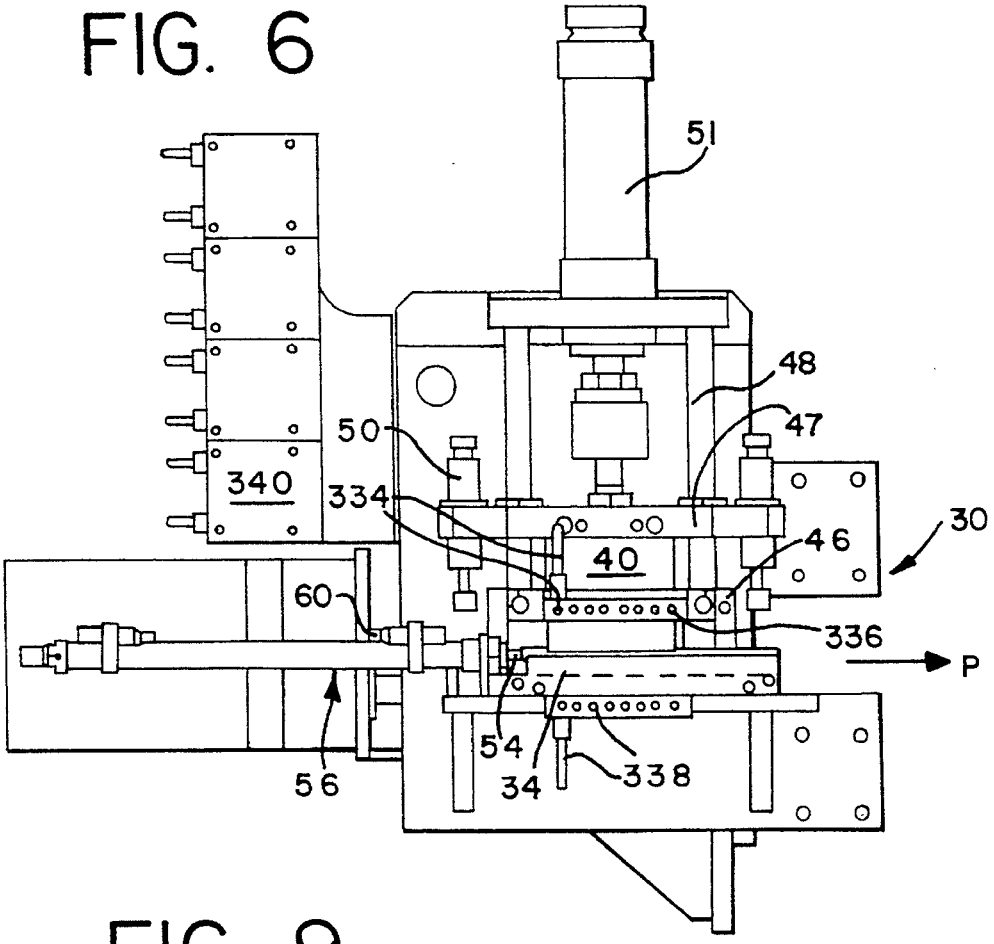
FIG. 6 is a front elevational view of the loading station of the feed assembly of FIG. 2 taken along lines 6—6 of FIG. 4.

Returning to the first embodiment of the feed apparatus 10 illustrated in FIGS. 2–6, it can be seen that the apparatus includes a means for guiding the supply belts of connecter housings 200 to a location for separation, shown as a connector housing advancement mechanism 12. This advancement mechanism 12 includes an elongated conveyer 14 extending between two opposing sidewalls 16, 18 and generally parallel to the axes L of the connector housing supply chains 216 when they are loaded thereon. The conveyor 14 is supported upon frame member 20 which extends the length thereof and encloses moving portions thereof, such as the drive belt 22 and drive rollers 23 (FIG. 4). The advancement mechanism 12 preferably includes an entrance chute 24 disposed at an entrance or upstream end 26 which provides a smooth transition between a supply station 114 (FIG. 1) and the moving support surface of the advancement mechanism 12 as defined by the conveyor drive belt 22.

The supply station 114 contains a plurality of connector supply chains 216 of the construction described above and illustrated in FIGS. 7 & 8. These multiple supply chains 216 are positioned at the entrance 26 of the advancement mechanism 12 by a suitable means in columnar, side-by-side order so that the connectors 200 in each supply chain reliably engage the conveyor drive belt 22. The connector supply chains 216 preferably occupy the entire support surface of the conveyor drive belt 22 in a side-by-side order in successive rows 218 as illustrated in FIG. 7, disposed between the advancement mechanism sidewalls 16, 18. The sidewalls 16, 18 of the advancement mechanism 12 may include a means for sensing the ends of the connector housing supply belts 216, such as optical sensors 28 (FIG. 2) which projects a beam of light across the conveyor belt 22, and which are preferably operatively connected to a control means (not shown) which monitors the operational status of the apparatus 10 and synchronizes the advancement mechanism 12 with other mechanisms of the loading station 10.

The advancement mechanism 12 leads to a connector housing separation and shuttle means, illustrated as a loading station 30, which is disposed near the exit 27 of the advancement mechanism 12. At the loading station 30, the lead rows 218 of connectors are successively separated from the connector supply chains 216 and transferred along a feed path P (FIGS. 3, 6, 9), generally perpendicular to the axis L of advancement mechanism 12. The feed path P leads to the termination transfer carriage assembly 112 (FIG. 1) stationed downstream of the feed channel 32 in the harness-making machine 100, by which the connector housings are transferred to a termination station 102 as described above.

The feed path P of the loading station 30 is defined primarily by a base member 31 which extends across the exit 27 of the advancement mechanism 12. The base member 31 includes an elongated feed channel 32 defined therein with a floor portion 33 extending between two opposing parallel sidewalls 34, 35. The outermost sidewall 34 is generally continuous in its extent within the base member 31 for substantially the entire length of the feed channel 32. The outermost sidewall 34 presents a stop abutment face for restricting movement of the lead row 218 of connectors 200 along the axis L of advancement mechanism 12 and defines a registration position for the lead row 218 of connectors 200. The innermost sidewall 35 has an interruption 36 (FIG. 9) disposed therein which defines a passage 37 which communicates with the advancement mechanism 12 and is aligned with the advancement conveyor 22. An exit guide plate 29 provides a transition between the conveyor 22 and the feed channel 32 and extends between the end of the conveyor 22 and the feed channel floor portion 33. As illustrated in the drawings, it is preferred that the feed channel 32 and advancement mechanism 12, intersect at the loading station 30 at a right angle thereto in order to permit uniform advancement of the lead rows 218 of connector housings 200 into the feed channel 32.

The loading station 30 encompasses the intersection of the feed channel 32 and the advancement mechanism 12 and includes a means for separating the lead row 218 of connectors 200, illustrated in FIGS. 2–6 and 9 as a severing knife 40 which is driven in reciprocating movement along a line that projects along the edge of the feed channel 32. The severing knife 40 has an elongated blade portion 42 which is preferably at least equal in length to the width of the feed channel-conveyor passage 36. The knife 40 may be partially received within a guide slot 44 on a mounting block 46 therefor.

The severing knife 40, during its cutting stroke, severs the bridging portions 215 interconnecting the connectors 200 together and remains in place temporarily to close off the feed channel passage 36. While the passage 36 is closed off by the knife 40, the elongated blade portion 42 thereof provides a substantially planar surface which effectively fills the passage 36 in the interrupted feed channel sidewall 35. After the cutting stroke and while the blade remains in its lowered position, the feed channel 32 has a continuous sidewall 35 along its extent within the base member 31 against which the connector housings abut as they are driven from the feed channel 32.

The severing knife 40 is supported on a mounting block 47, such as by bolts, which reciprocates along one or more guide posts 48. The guide posts 48 may include a pair of collar members 50 disposed thereon which serve as stop surfaces that limit the extent of travel of the severing knife 40 thereon. The severing knife 40 is driven in its reciprocating movement by a conventional fluid or air cylinder 51 which may be controlled by one or more proximity switches 52 operatively connected to the severing knife 40.

The loading station 30 further preferably includes a means for advancing successively separated rows 218 of connectors 200, along the feed path P, illustrated as a push rod 54 mounted within a fluid cylinder 56 in alignment with the feed path P of the feed channel 32. The push rod 54 includes an engagement head which engages the severed lead rows 218 of connectors 200 in the feed channel 32 and shuttles, or transfers, them out of the feed channel 32 into a corresponding channel 113 (FIG. 1) of the termination transfer carriage assembly 112. Accordingly, it is desirable that the stroke of the push rod 54 be of a length sufficient to push the entire row 218 of severed connector housings out of the feed channel 32. A conventional proximity switch 60 (FIG. 6) may be utilized to control the movement of the push rod 54 and generate a signal to a control means (not shown) indicating that the severed row 218 has been moved out of the feed channel 32 into the transfer carriage assembly 112. The outermost sidewall 34 may desirably include a horizontal slot 62 (FIG. 9) which receives a guide 55 extending laterally from the push rod engagement head during its travel through the feed channel 32.

Figure 9:
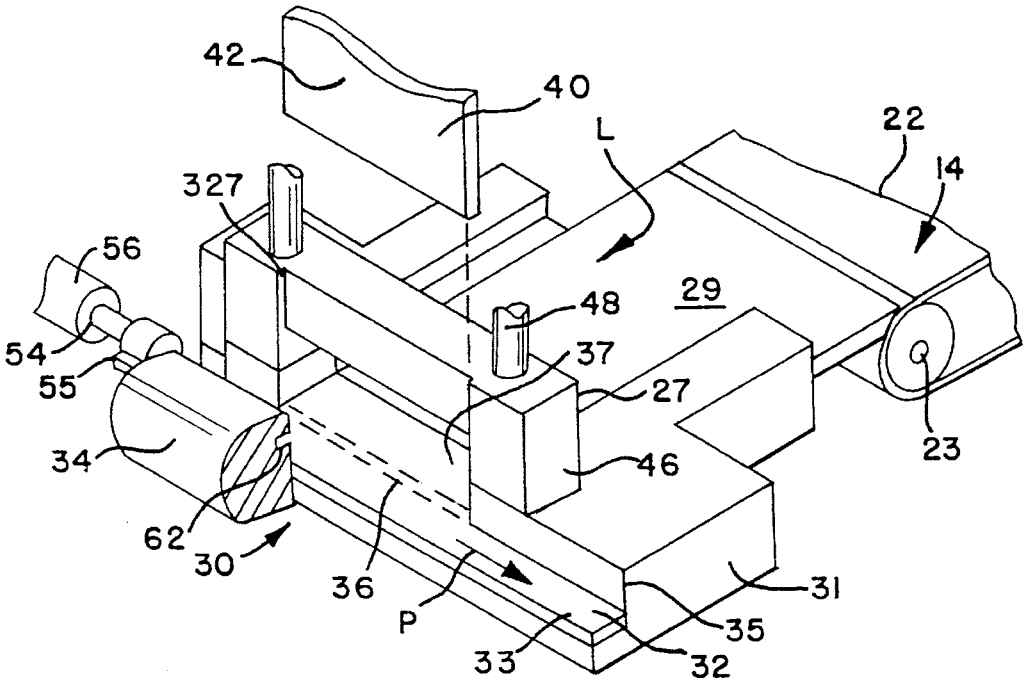
FIG. 9 is an enlarged perspective view of the loading station of the feed assembly of FIG. 2.

As best illustrated in FIG. 9, the severing knife blade 42 is moved downwardly along a recess 327 formed in knife blade mounting block 47 affixed to the loading station base member 31 which opposes the optical sensor mounting block 46. The knife follows the path indicated by the dashed lines in FIG. 9.

In an important aspect of the present invention, the loading station 10 may include means for verifying the presence or absence of each connector of the lead row 218 of connectors advanced by the advancement mechanism 12, illustrated as a series of optical sensors 334 which are arranged in line within an optical sensor mounting block 46 which forms a portion of the knife guide slot 326. It is preferred that the optical sensors 334 be aligned with the feed channel 32 and, in this regard, the feed channel 32 may further include a matching number of sensors 338 disposed therein in alignment with the upper optical sensors 334 (FIG. 4). The optical sensors may include a plurality of fiber optic cables extending from their mounting block 46 to a bank of individual amplifiers 340 (FIG. 6) mounted on the frame of the apparatus 310. The sensors 334 permit the operator to verify the presence of each connector housing in the lead row 218 entering the feed channel. In the case of the absence of a connector, the sensors may be operatively connected to an alarm means for generating an alarm signal to indicate to the operator that one connector supply chain has completely exhausted itself or is stopped within its movement or prevented from advancing within the advancing mechanism. Furthermore, the sensors may be utilized to verify the alignment of the lead row 218 of connectors therein.

It will be appreciated that the embodiments of the present invention which have been discussed are merely illustrative of some of the applications of this invention and that numerous modifications may be made by those skilled in the art without departing from the true spirit and scope of this invention.

We claim:

1. An apparatus for separating and feeding electrical connectors from a supply of electrical connectors to a processing station, said supply of electrical connectors including a plurality of electrical connectors with adjacent ones of said electrical connectors interconnected by webs, said supply of electrical connectors being generally linear, said separating and feeding apparatus comprising:

first guide means for guiding said supply of interconnected connectors along a first path to a separating station such that a lead connector of such supply is presented to said separating station;

second guide means for guiding said lead connector to said processing station after separation from said adjacent interconnected connector, said second guide means defining an elongated second path generally transverse to said first path, said second guide means comprising a channel defined by first and second generally parallel sidewalls and a lower surface interconnecting said sidewalls, said first sidewall having an opening therein aligned with said first path to permit said lead connector to enter said second guide means and said second sidewall for restricting movement of said lead connector along said first path and defining a registration position for said lead connector;

sensor means for verifying the presence of said lead connector at said registration position;

means to move said lead connector along said channel from said separating station to said processing station; and severing means at said separating station for severing a web interconnecting said lead connector with an adjacent interconnected connector, said severing means including at least one substantially planar surface aligned with and positionable at said opening in said first sidewall of said second guide means to close said opening in said first sidewall and form a generally continuous guide surface for guiding said lead connector between said separating station and said processing station.

2. The separating and feeding apparatus as set forth in claim 1, wherein said sensor means includes an optical sensor disposed at an intersection of said first and second paths.

3. The separating and feeding apparatus as set forth in claim 2, wherein said severing means includes an elongated, plate-shaped knife for severing said web and for closing said opening in said first sidewall.

4. The separating and feeding apparatus as set forth in claim 2, wherein said second guide means includes a push rod aligned with said channel and which upon actuation engages said lead connector and pushes said lead connector toward said processing station after separation from said supply of interconnected electrical connectors.

5. The separating and feeding apparatus as set forth in claim 1, wherein said sensor means includes a plurality of optical sensors disposed at an intersection of said first and second paths for sensing a plurality of connectors aligned along said second path and located at said registration position.

6. The separating and feeding apparatus as set forth in claim 1, wherein said severing means includes an elongated, plate-shaped knife for severing said web and for closing said opening in said first sidewall.

7. The separating and feeding apparatus as set forth in claim 6, wherein said second guide means includes a push rod aligned with said channel and which upon actuation engages said lead connector and pushes said lead connector toward said processing station after separation from said supply of interconnected electrical connectors.

8. The separating and feeding apparatus as set forth in claim 1, wherein said first guide means includes a conveyor, the conveyor including a pair of opposing sidewalls which define a connector housing supply advancement channel aligned with said conveyor and generally parallel to said first path.

9. The separating and feeding apparatus as set forth in claim 8, wherein said conveyor is an endless belt.

10. The separating and feeding apparatus as set forth in claim 1, wherein said first and second guide means intersect each other.

11. The separating and feeding apparatus as set forth in claim 10, wherein said severing means includes an elongated, plate-shaped knife for severing said web and for closing said opening in said first sidewall.

12. The separating and feeding apparatus as set forth in claim 1, wherein said severing means includes a reciprocating knife operatively connected to said sensor means.

13. The separating and feeding apparatus as set forth in claim 1, wherein said second guide means includes a push rod aligned with said channel and which upon actuation engages said lead connector and pushes said lead connector toward said processing station after separation from said supply of interconnected electrical connectors.

14. The separating and feeding apparatus as set forth in claim 1, wherein said first and second generally parallel sidewalls have a height substantially as great as the height of said electrical connector.

15. An apparatus for separating and feeding electrical connectors from a supply of electrical connectors to a processing station, said supply of electrical connectors including a plurality of electrical connectors with adjacent ones of said electrical connectors interconnected by webs, said supply of electrical connectors being generally linear, said separating and feeding apparatus comprising:

first guide means for guiding said supply of interconnected connectors along a first path to a separating station such that a lead connector of said supply is presented to said separating station;

second guide means for guiding said lead connector to said processing station after separation from said adjacent interconnected connector, said second guide means defining an elongated second path generally transverse to said first path, said second guide means being defined by first and second generally parallel sidewalls and a lower surface interconnecting said sidewalls, said first sidewall having an opening therein aligned with said first path to permit said lead connector to enter said second guide means and said second sidewall for restricting movement of said lead connector along said first path and defining a registration position for said lead connector;

sensor means for verifying the presence of said lead connector at said registration position;

means to move said lead connector from said separating station to said processing station; and severing means at said separating station for severing a web interconnecting said lead connector with an adjacent interconnected connector, said severing means including at least one substantially planar surface aligned with and positionable at said opening in said first sidewall of said second guide means to close said opening in said first sidewall and form a generally continuous guide surface against which said lead connector abuts during movement from said separating station to said processing station.

16. The separating and feeding apparatus as set forth in claim 15 wherein said first and second generally parallel sidewalls and said lower surface interconnecting said sidewalls define a channel which is completed when said planar surface of said severing means is positioned at said opening in said first sidewall.

17. The separating apparatus and feeding apparatus as set forth in claim 15, wherein said severing means includes an elongated, plate-shaped knife for severing said web and for closing said opening in said first sidewall.

* * * * *